United States Patent [19]

Adams et al.

[11] Patent Number: 4,562,633

[45] Date of Patent: Jan. 7, 1986

[54] RAILWAY BOX CAR CONVERSION TO HIGHWAY TRAILER-CARRYING FLATCAR AND METHOD OF ACCOMPLISHING IT

[75] Inventors: Norman S. Adams, Cincinnati; Eugene T. Fehrenbach, Maineville; John A. Ritter, Cincinnati, all of Ohio

[73] Assignee: Ortner Freight Car Company, Milford, Ohio

[21] Appl. No.: 585,228

[22] Filed: Mar. 1, 1984

[51] Int. Cl.[4] ..... B61D 17/00; B23P 17/04

[52] U.S. Cl. ..... 29/401.1; 105/1 A; 105/355; 105/404; 105/413

[58] Field of Search ..... 105/355, 363, 377, 404, 105/411, 4 B, 1 A; 29/401.1

[56] References Cited

U.S. PATENT DOCUMENTS 3,034,454 5/1962 Tatarchuk ..... 105/355 X 3,717,155 3/1973 O'Leary ..... 105/355 X

*Primary Examiner*—Howard N. Goldberg

*Assistant Examiner*—Vernon K. Rising

*Attorney, Agent, or Firm*—Frost & Jacobs

[57] ABSTRACT

A railway flatcar for carrying a highway trailer, the flatcar having been converted from a conventional railway box car. The sides, ends and roof of a conventional box car are cut and removed therefrom substantially at the floor line. The side sill assemblies of the car are reinforced substantially throughout their length. At the bogie end of the car, those portions of the out-board floor stringers spanning between adjacent cross ties and cross bearers are reinforced. The cross ties are also reinforced and/or additional cross ties added at the bogie end of the car. At the hitch end of the car, appropriate reinforcement and mounting means are located along the bolster and center sill to which a conventional trailer hitch is affixed. When the car is to be used with circus style loading ramps, the trailer hitch is of the retractable type and the floor of the car is left in tact throughout the length of the car, except at the position of the trailer hitch, with longitudinally extending curb members mounted above the side sill assemblies. When the car is to be used with overhead or side loading crane equipment, the trailer hitch may be of the rigid type; the car floor is removed from the hitch end of the car; and the floor at the bogie end of the car supports tire guides positioned to be straddled by the highway trailer tires. The brake wheel and support therefor are relocated to one side of the flatcar near the B end thereof.

23 Claims, 20 Drawing Figures

1
A
C
9
6A
7A
8A
15
18
20
24
28
28a
28b
28c
28d
28e
29
30
30a
30b
30c
30d
32
32a
32b
33
33a
33b
34
35a
35b
36a
36b
37
39
40
41
42
43
47
49
49c 64
61
62
42a
67
63
65
24
29
60

64
62
67
42
42a
63
32c
65
35a
24
36a
32b
32
29
27
30
31c 42a
29
50
55
42

RAILWAY BOX CAR CONVERSION TO HIGHWAY TRAILER-CARRYING FLATCAR AND METHOD OF ACCOMPLISHING IT

TECHNICAL FIELD

The invention relates to a highway trailer-carrying railway flatcar, and more particularly to a conversion flatcar made from a conventional box car, and to the method of conversion.

BACKGROUND ART

In recent years, there has been a dynamic growth in piggyback carloadings, i.e. the mounting and shipping of highway trailers on railway flatcars. Over the years, flatcars for this purpose have been made larger and larger, and are currently being made in a standard 89-foot, 4-inch length, the maximum allowable length for a rail car according to A.A.R. (Association of American Railroads) rules. Such cars are provided with two trailer hitches and are intended to carry two highway trailers in tandem arrangement. Recently, highway trailers have been made in ever increasing lengths, up to 45 feet and 48 feet (with the possibility of up to 50 feet in the near future). It will be evident that a pair of highway trailers of such length cannot be mounted on a standard 89-foot, 4-inch railway flatcar without modification of the flatcar, and, as a result, only one 45-foot or 48-foot highway trailer can be accommodated on such a car.

This is an undesirable situation for a number of reasons. First of all, it means that there is a considerable waste of valuable cargo-carrying space per car. In a train of such cars, such waste of cargo-carrying space is multiplied. This also means that each highway trailer is being carried on a railway car of greater size and weight than would otherwise be required. Aerodynamically, it is advantageous to locate the highway trailers as close together as possible, end-to-end, which is not possible under these circumstances.

At the present time, a number of railroads have an over-abundance of older box cars which have been replaced by box cars of greater length and greater capacity. If such box cars have a length of at least 50 feet, most of them are convertible to flatcars capable of accommodating a single highway trailer of a length ranging from about 40 feet to 48 feet, even if the trailer is provided with a front mounted or nose mounted refrigerator unit (and trailers of 50-foot length provided with an underslung refrigerator unit). The present invention is directed to such conversion flatcars and a method of producing them.

The teachings of the present invention can be applied to many types of box cars produced by a variety of manufacturers. The primary constraint is that the box car have a length of at least 50 feet. For purposes of an exemplary showing, the invention will be taught in terms of the conversion of a 50-foot, 50-ton box car. It will be understood that box cars of greater length and greater tonnage capacity could be used. For purposes of description, a 50-foot, 50-ton box car has been selected for a number of reasons. First of all, there is currently an over-abundance of such cars. Secondly, such cars are not in as great demand for service, as are cars of greater size and capacity, such as 50-foot, 70-ton cars; 60-foot, 70-ton cars; and so on.

In the practice of the present invention, the sides, ends and roof of the box car are removed at substantially the floor line of the car. It will be understood that the underframe of such a car derives some of its strength in service from the sides, ends and roof, having been initially designed with these members in mind. Therefore, a part of the conversion process entails the appropriate strengthening of the car underframe for the loads anticipated, so that the conversion car can meet A.A.R. standards for such cars.

That some box cars constitute better candidates for conversion than others, will be readily apparent to one skilled in the art. For example, box cars having oversized doors, double doors or staggered doors will initially have heavier side sills of greater strength than similarly-sized box cars having single 8-foot wide doors on each side. While some additional changes or modifications may have to be made, depending upon the nature of the box car being converted, the teachings of the present invention are generally applicable to any box car constituting a reasonably good candidate for conversion.

DISCLOSURE OF THE INVENTION

According to the invention, there is provided a railway flatcar for carrying a highway trailer. The flatcar is made from a conventional railway box car of at least 50-foot length. The sides, ends and roof of the conventional box car are cut and removed from the underframe, substantially at the floor line. The side sill assemblies of the car are extended to the end sills and are reinforced substantially throughout their length and an appropriate bulb angle or curb member is mounted substantially the length of the car, above each side sill. The end sills may also be reinforced if required.

At the highway trailer bogie supporting end of the car, hereinafter called the bogie end of the car, the cross ties, located between the cross bearers, are reinforced. Where mechanical equipment location beneath the car frame prevents such cross tie reinforcement, an additional cross tie can be added, extending between the center sill and a side sill of the frame. At the bogie end of the car, on each side of the car, those portions of the outboard floor stringers, spanning between the bolsters, cross ties and the cross bearers, are themselves reinforced. Should a cross bearer require reinforcement, this can be accomplished in substantially the same way as the reinforcement of a side sill assembly, as will be explained hereinafter.

At the trailer hitch mounting end of the car, hereinafter referred to as the hitch end of the car, appropriate reinforcement and mounting means are provided, in association with the center sill and the bolster, to which a conventional trailer hitch is affixed. In a car intended to be used with circus loading facilities, the existing nailable floor of the car is left in tact, except at the position of the trailer hitch, and the trailer hitch should be of the collapsible type. In a car intended for circus loading, curb members are located above the side sills and along the length of the car, to guide the highway trailer in place.

In a car intended to be used with top or side loading crane facilities, the trailer hitch may be of the rigid, non-retractable type, and the existing nailable floor at the hitch end of the car may be removed for weight saving purposes. In such an instance, the floored portion of the car may be provided with curb members or tire guides so positioned as to be straddled by the tires of the highway trailer, when in place.

Finally, in both flatcar embodiments, the conventional brake wheel and support therefor are relocated at one side of the car, at the B end thereof.

DETAILED DESCRIPTION OF THE INVENTION

Highway trailer-carrying railway flatcars of the type to which the present invention is directed fall into two general categories. The first category includes those flatcars for use in terminals wherein the highway trailer is placed upon the flatcar by means of side loading, crane-like equipment or overhead loading crane-like equipment, the latter type of crane straddling the flatcar. The second general category includes those flatcars for use in terminals having the so-called "circus style" loading ramps. In this type of facility, the highway trailers are driven onto and off of the cars and can be driven along the cars, from one car to the next, through the use of short, removable ramps, spanning the distance between the cars.

The conversion flatcar of the present application can be provided in either embodiment or version. As will be evident hereinafter, the crane loaded version of the flatcar, utilizing overhead or side loading crane equipment, differs from the circus loaded car primarily in the type of curbs applied to the car, the extent of the car flooring and the type of trailer hitch applied to the car.

Figure 1:
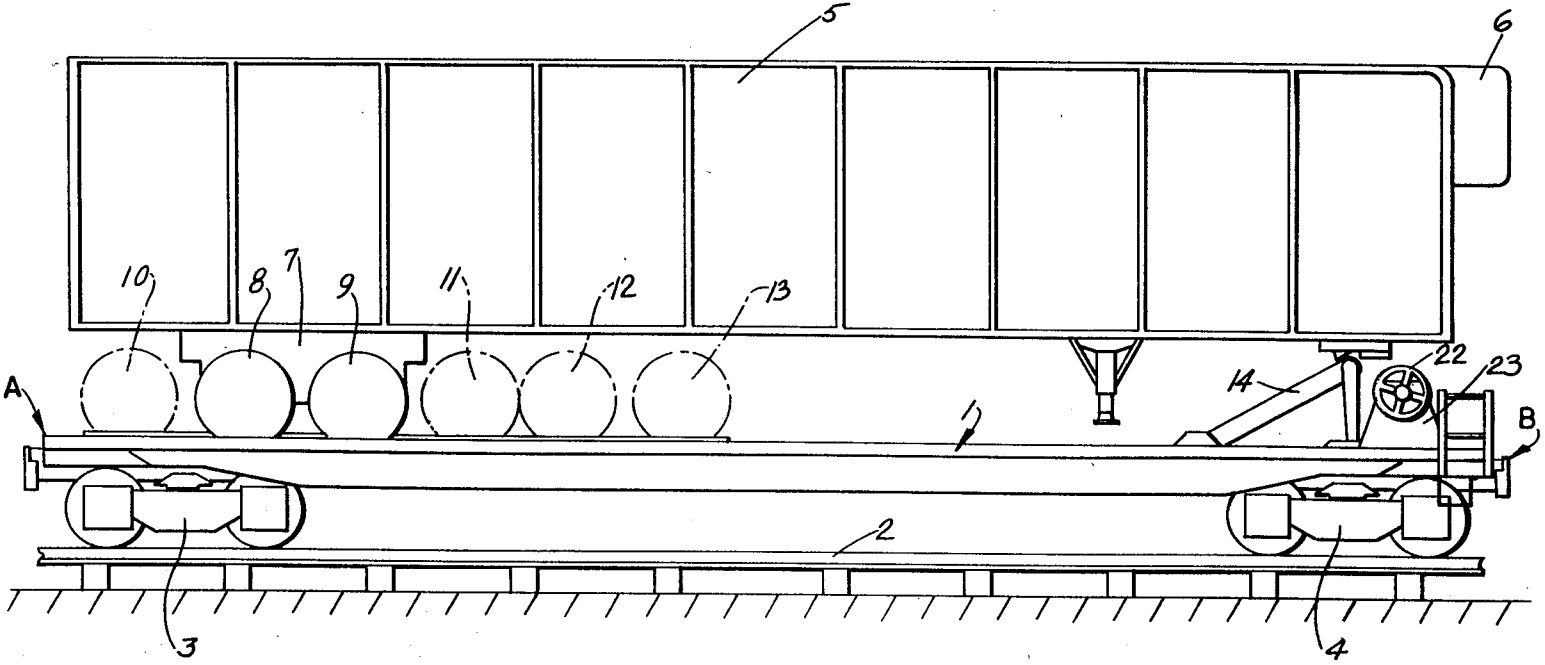
FIG. 1 is a semi-diagrammatic, simplied, elevational view of a conversion car of the present invention with a 48-foot highway trailer mounted thereon.

Turning first to FIG. 1, an exemplary flatcar of the present invention is generally indicated at 1. In FIG. 1, the car 1 is illustrated as being of the crane loaded type, but for purposes of this discussion, it could also be considered to be of the circus loaded type. In the description which follows and in all of the Figures, the flatcars are, for purposes of an exemplary showing only, illustrated as being conversion cars made from conventional 50-foot, 50-ton box cars. The car 1 is supported on conventional railroad rails, one of which is shown at 2, by means of conventional trucks 3 and 4. The A and B ends of the cars are designated in FIG. 1. The designations "A end" and "B end" are terms of the art well known to the skilled worker therein. As most commonly used, the A end of the car refers to that half of the car extending from the longitudinal center of the car toward the A end, while the B end of the car refers to that half of the car extending from the longitudinal center of the car toward the B end thereof, at which end the hand brake is mounted. Similarly, as used herein and in the claims, the term "bogie end" refers to that longitudinal half of the car supporting the highway trailer bogie and the term "hitch end" refers to that longitudinal half of the car on which the trailer hitch is mounted. In the Figures, the bogie end is shown to be the A end and the hitch end is shown to be the B end. This is not a limitation of the invention and could be reversed, the bogie end being the B end and the hitch end being the A end.

In FIG. 1, a conventional 48-foot highway trailer 5 is shown mounted on conversion flatcar 1. Although the highway trailer 5 is illustrated as having a nose mounted refrigerator unit 6, the trailer 5 still remains well within the confines of flatcar 1. The highway trailer 5 is provided with a conventional bogie 7 having two pairs of axle-mounted wheel assemblies 8 and 9. On many highway trailers, the bogie 7 is adjustable longitudinally of the trailer. The broken line circle 10 of FIG. 1 illustrates the rearwardmost position of the rearward wheel set on a 48-foot trailer. Broken line circles 11 and 12 illustrate additional wheel set positions. The broken line circle 13 indicates the forwardmost position of the forward wheel set of a conventional 40-foot trailer. It will, therefore, be evident that the bogie end of flatcar 1 can accommodate the bogie wheel sets of highway trailers ranging from 40-foot length to 48-foot length. The forward end of the highway trailer is affixed to and supported by a conventional trailer hitch 14. If a 50-foot highway trailer is mounted on the flatcar, the trailer hitch would have to be shifted further away from the bogie end of the car. It will be evident from FIG. 1 that the sides, ends and roof of conversion car 1 have been removed, substantially at the floor level.

Figure 2:
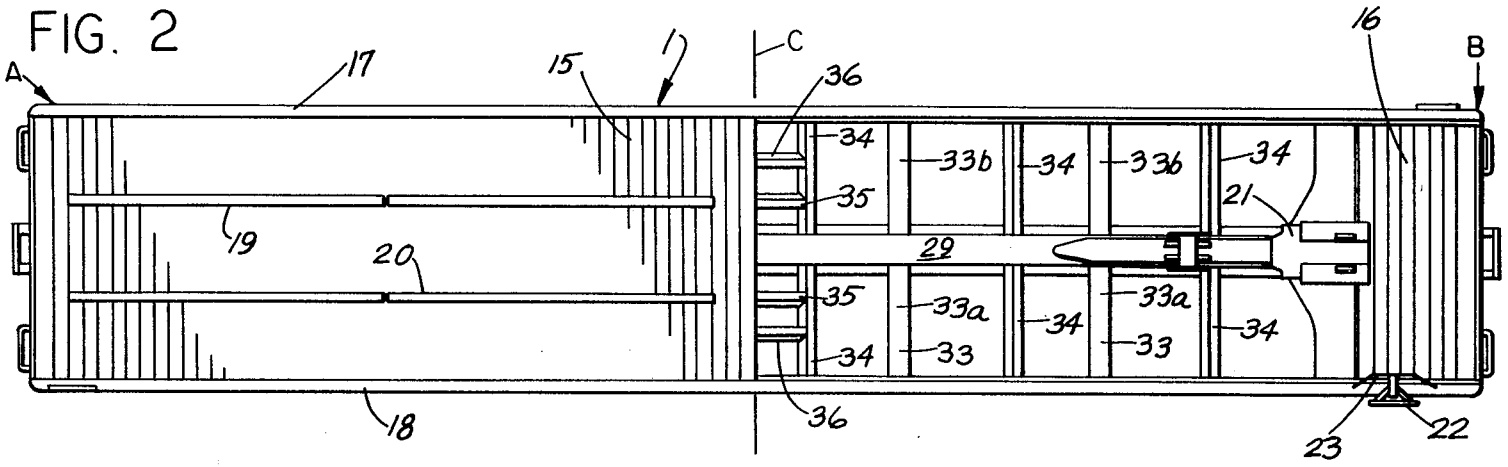
FIG. 2 is a simplified plan view of the side or overhead crane loaded embodiment of the conversion car of the present invention.

Reference is now made to FIG. 2. FIG. 2 illustrates, in simplified form, a plan view of the crane loaded car of FIG. 1, the highway trailer 5 having been removed. In the crane loaded embodiment of FIG. 2, the original nailable steel floor is retained at the bogie end of the car up to the longitudinal center thereof, as at 15. A small section of the floor is retained at the hitch end of the car, as at 16. The nailable steel floor is removed from the remainder of the car since it is unnecessary and would simply add unnecessary weight to the car.

As will be more fully described hereinafter, along the longitudinal side edges of the flatcar 1, bulb angles 17 and 18 are provided, both to finish the car and to lend additional rigidity to the side sills. The floor section 15 of the bogie end of the car is provided with a pair of upstanding wheel guides 19 and 20 in parallel-spaced relationship and extending longitudinally of the flatcar 1. The wheel guides 19 and 20 are so spaced as to be just nicely straddled by the wheel sets of the highway trailer.

At the hitch end of flatcar 1, an appropriate mount (generally indicated at 21) is provided for the conventional trailer hitch 14 (see FIG. 1). While the trailer hitch 14 may be of the collapsible type, since the embodiment of the flatcar 1 illustrated in FIGS. 1 and 2 is of the crane loaded type, a collapsible hitch is not required and a hitch of the rigid type is adequate. It will further be noted that the conventional hand brake 22 and mounting means 23 therefor have been relocated at the side of the flatcar 1, at the B end thereof.

Figure 3:
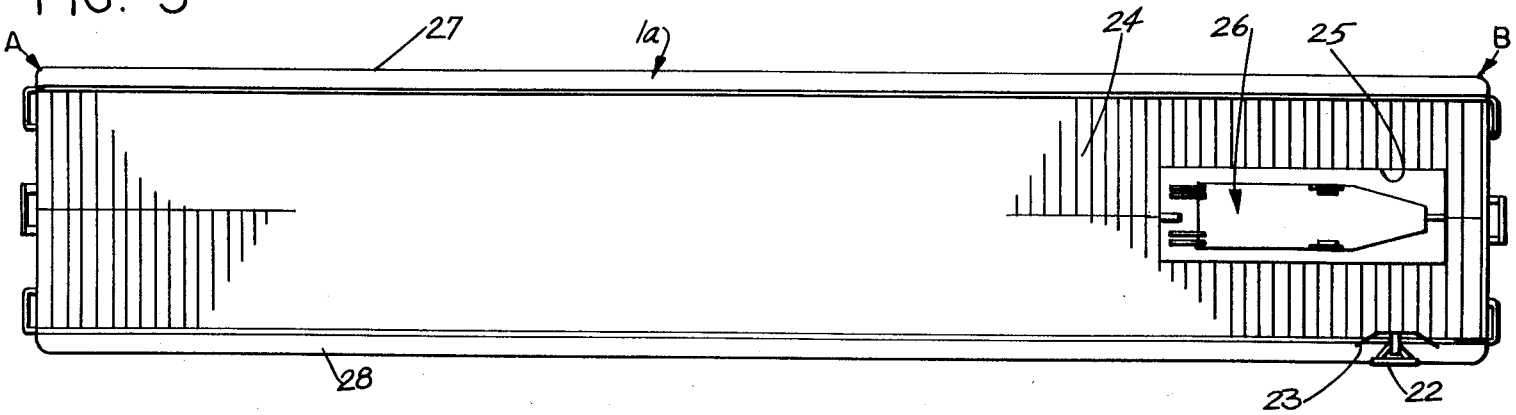
FIG. 3 is a simplified plan view of the circus loaded embodiment of the conversion car of the present invention.
Figure 4A:
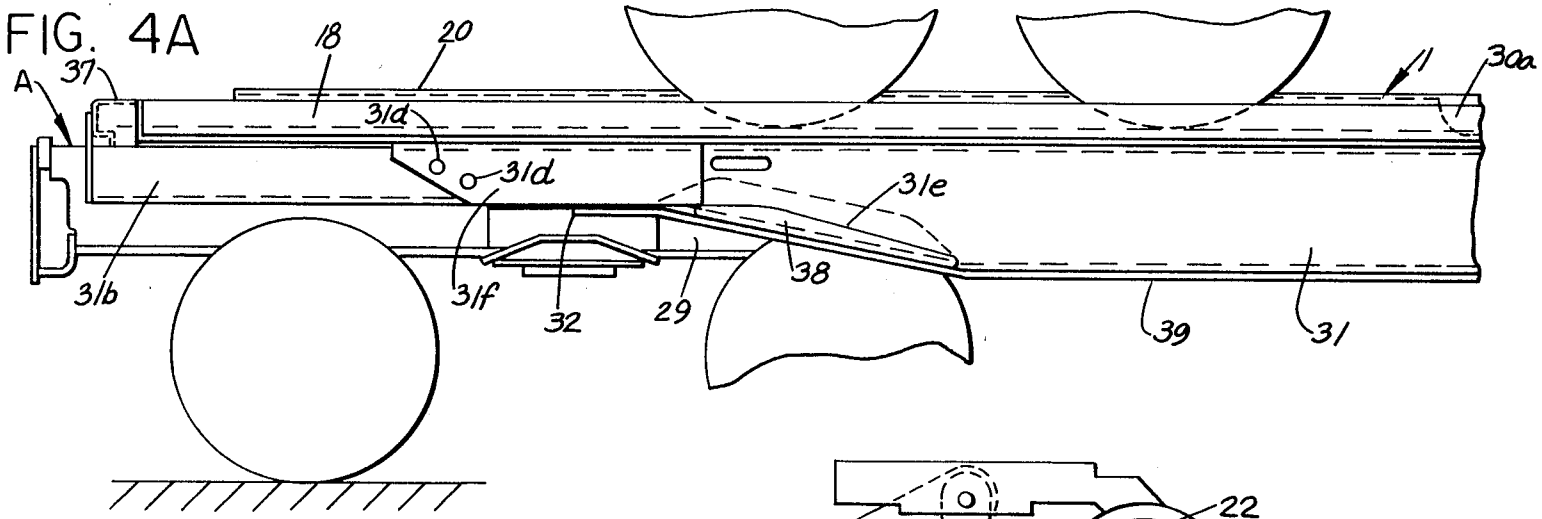
FIG. 4A is a fragmentary, simplified, elevational view of the bogie end of the conversion car of FIG. 2.
Figure 4B:
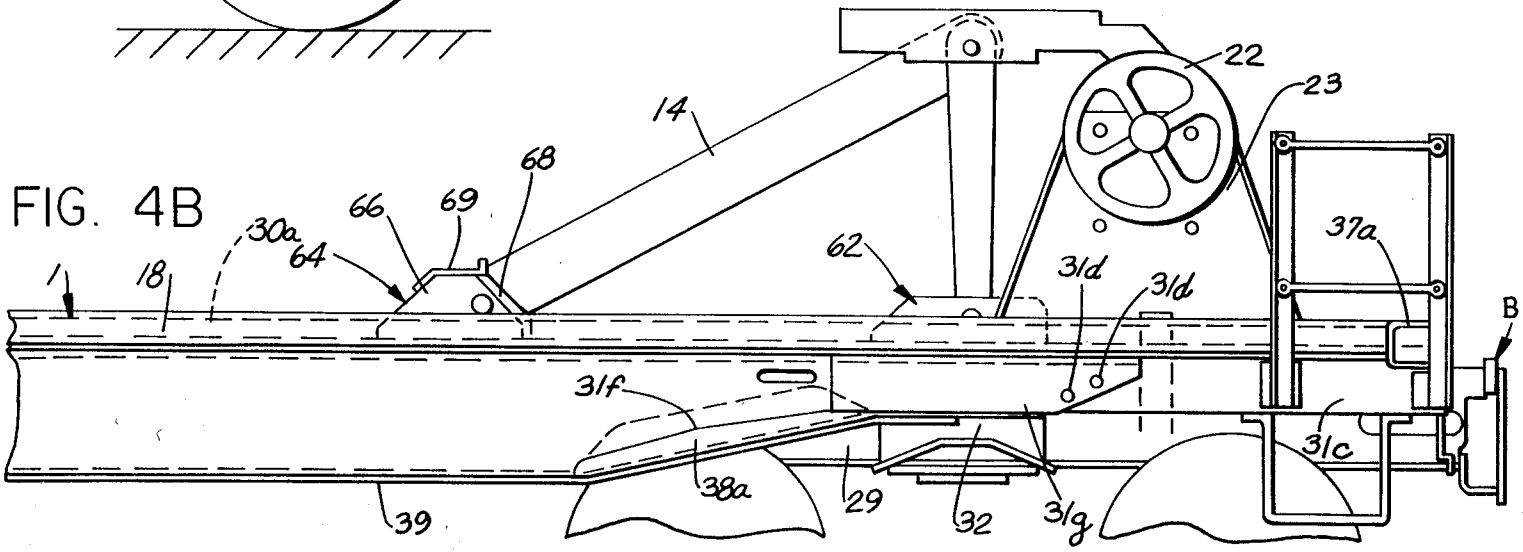
FIG. 4B is a fragmentary, simplified, elevational view of the hitch end of the conversion car of FIG. 2.

FIG. 3 is a simplified plan view, similar to FIG. 2, but illustrating the circus loaded embodiment of the converted flatcar of the present invention. In this instance, the flatcar (generally indicated at 1*a*) retains its nailable steel flooring 24 throughout the length of the car, except for a rectangular opening 25 formed therein to accommodate the mount for a trailer hitch. Such a mount is generally indicated at 26 in FIG. 3. Since circus loading involves a drive-on/drive-off procedure, the trailer hitch (not shown), to be affixed to mount 26, must be of the conventional collapsible type.

Along the longitudinal edges of the conversion flatcar 1*a*, curb members 27 and 28 are provided. As will be described in more detail hereinafter, the curb members 27 and 28 finish the longitudinal edges of the flatcar 1, lend additional strength to the side sills thereof, and act as curbs or guides for the highway trailers during the drive-on/drive-off loading and unloading procedures. Wheel guides equivalent to those shown at 19 and 20 in FIG. 2 are not required on the converted flatcar 1*a*. Finally, the flatcar 1*a* is provided with a relocated hand brake 22 and mount 23 therefor, identical to that of flatcar 1 of FIG. 2.

In the description of flatcars 1 and 1*a*, the floors 15, 16 and 24 are described as being nailable steel floors. While this is preferred, some boxcars have wooden floors. It is within the scope of the present invention to retain the original wood floor, replace the original wood floor with a new wood floor, or preferably replace the original wood floor with a nailable steel floor. The precise nature of the flooring material does not constitute a limitation of the present invention.

Figures 5A, 6A, 6B:
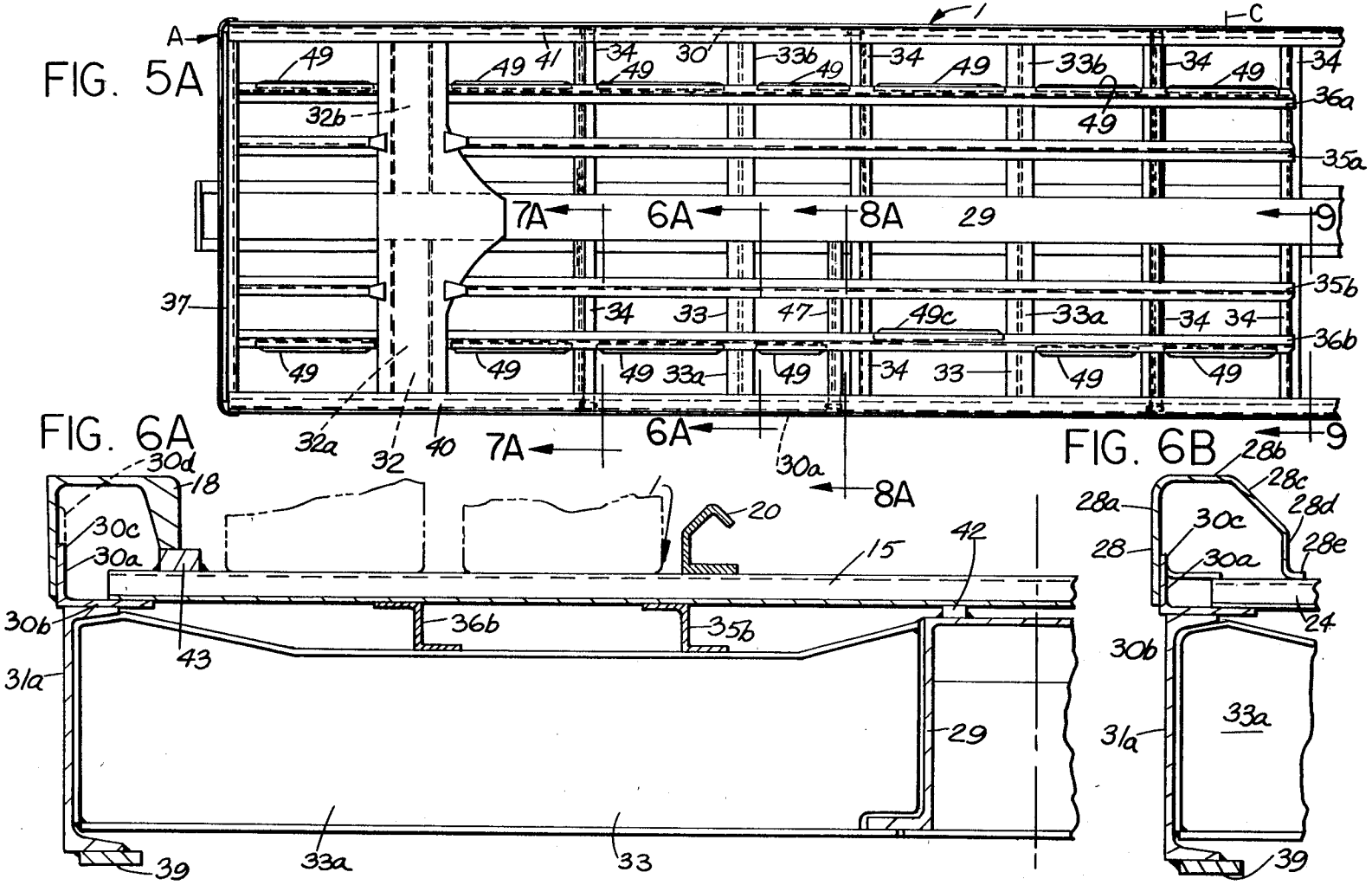
FIG. 5A is a fragmentary, simplified, plan view of the underframe of the flatcar of FIG. 2, or the flatcar of FIG. 3.
FIG. 6A is a fragmentary cross-sectional view taken along section line 6A—6A of FIG. 5A.
FIG. 6B is a fragmentary cross-sectional view, similar to FIG. 6A, and illustrating the type of curb used on the flatcar of FIG. 3.

Reference is now made to FIGS. 5A and 2. In FIG. 5A, the bogie end of the underframe of converted flatcar 1 is illustrated in somewhat simplified form (the nailable steel floor having been removed for purposes of clarity). FIG. 2 illustrates a portion at least of the underframe at the hitch end of the car 1. It will be understood that the underframe of car 1*a* of FIG. 3 (the circus loading car) will be identical.

The precise nature of the underframe of a box car will vary from manufacturer to manufacturer, and depends upon the nature of the box car itself, its door arrangements and the like. Nevertheless any box car constituting a good candidate for the conversion of the present invention will have substantially the same main structural members. Such good candidate cars will be provided with a center sill 29 extending centrally and longitudinally of the car. While the center sill may have any appropriate cross-sectional configuration, an inverted U-shaped configuration (see FIG. 11A) is common. Such cars are also provided with side sills 30 and 30*a* and side sill reinforcers 31 and 31*a*. These elements, taken together, are referred to herein and in the claims as "side sill assemblies" 30–31 and 30*a*–31*a*. The side sill assemblies 30–31 and 30*a*–31*a* extend substantially the length of the car in parallel-spaced relationship to each other and to the center sill, located to each side of the center sill. Such cars are also provided with end sills, shown at 37 and 37*a* (see also FIG. 5B).

Figure 11A:
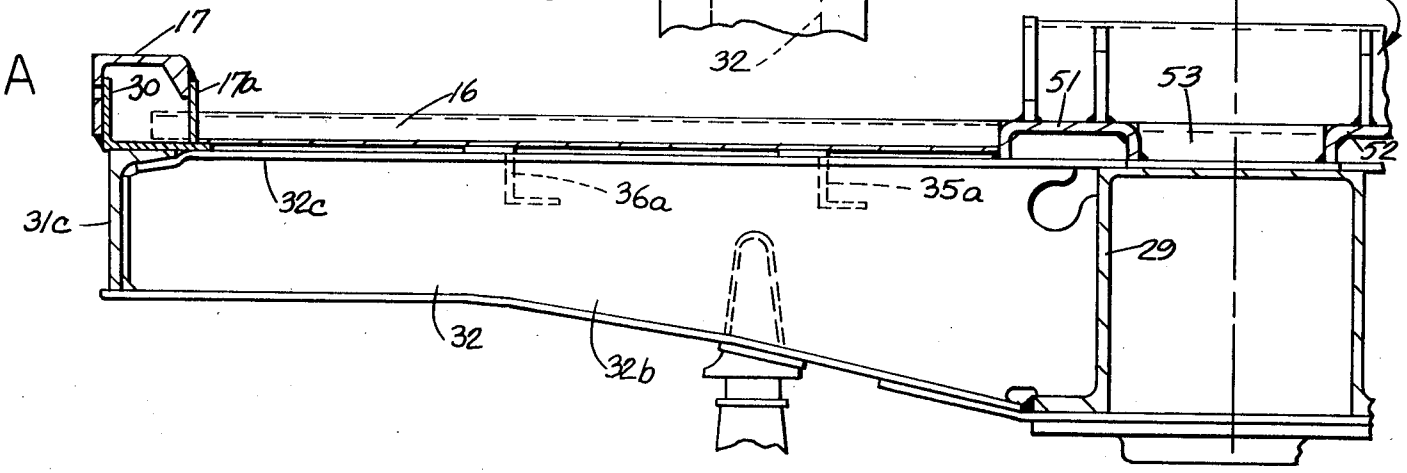
FIG. 11A is a fragmentary cross-sectional view taken along section line 11A—11A of FIG. 10A.
Figures 11B, 12A, 12B:
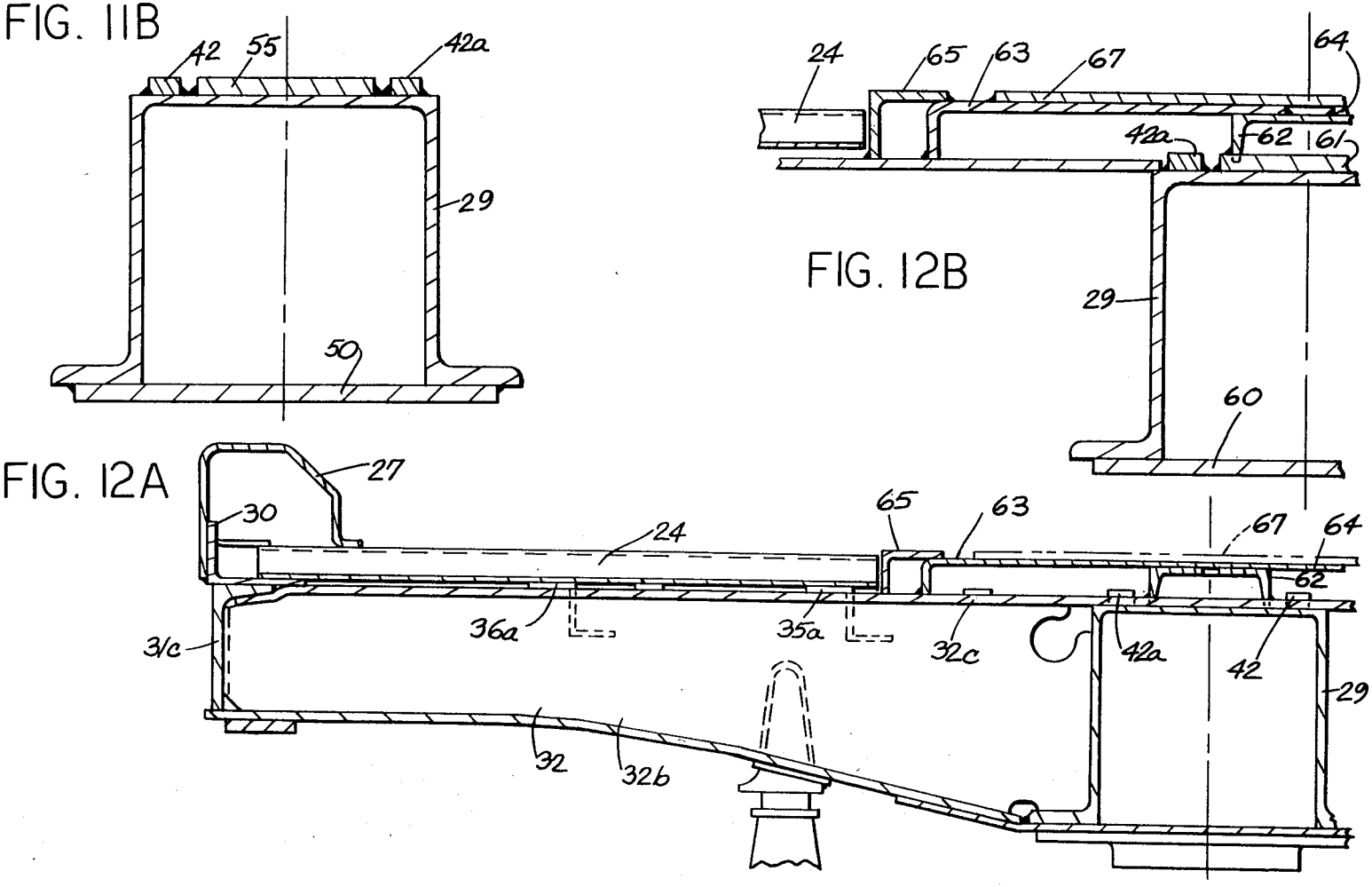
FIG. 11B is a cross-sectional view taken along section line 11B—11B of FIG. 10A.
FIG. 12A is a fragmentary cross-sectional view taken along section line 12A—12A of FIG. 10B.
FIG. 12B is a fragmentary cross-sectional view taken along section line 12B—12B of FIG. 10B.

A series of additional frame members extend from each side of the center sill to the adjacent one of the side sill assemblies 30–31 and 30*a*–31*a*. These transversely extending frame members take various forms. First of all, heavy duty transverse members or bolsters 32 are located both at the A end and the B end of the car at the position of the mounting of trucks 3 and 4. Bolsters 32 are illustrated in FIGS. 5A and 11A and 12A. The bolsters 32 are made up of two halves 32*a* and 32*b* which are welded or otherwise appropriately affixed to center sill 29 and the adjacent one of side sill reinforcers 31 and 31*a*.

Additional heavy duty transverse frame members, generally called cross bearers 33, are made up of two halves 33*a* and 33*b* which span between and are affixed to the center sill 29 and the adjacent one of the side sill reinforcers 31 and 31*a* (see FIGS. 5A and 6A). The exemplary conversion flatcar 1 of the present invention is illustrated as having four cross bearers 33. Two cross bearers 33 are illustrated in FIG. 5A and two are shown in FIG. 2.

Figure 7A:
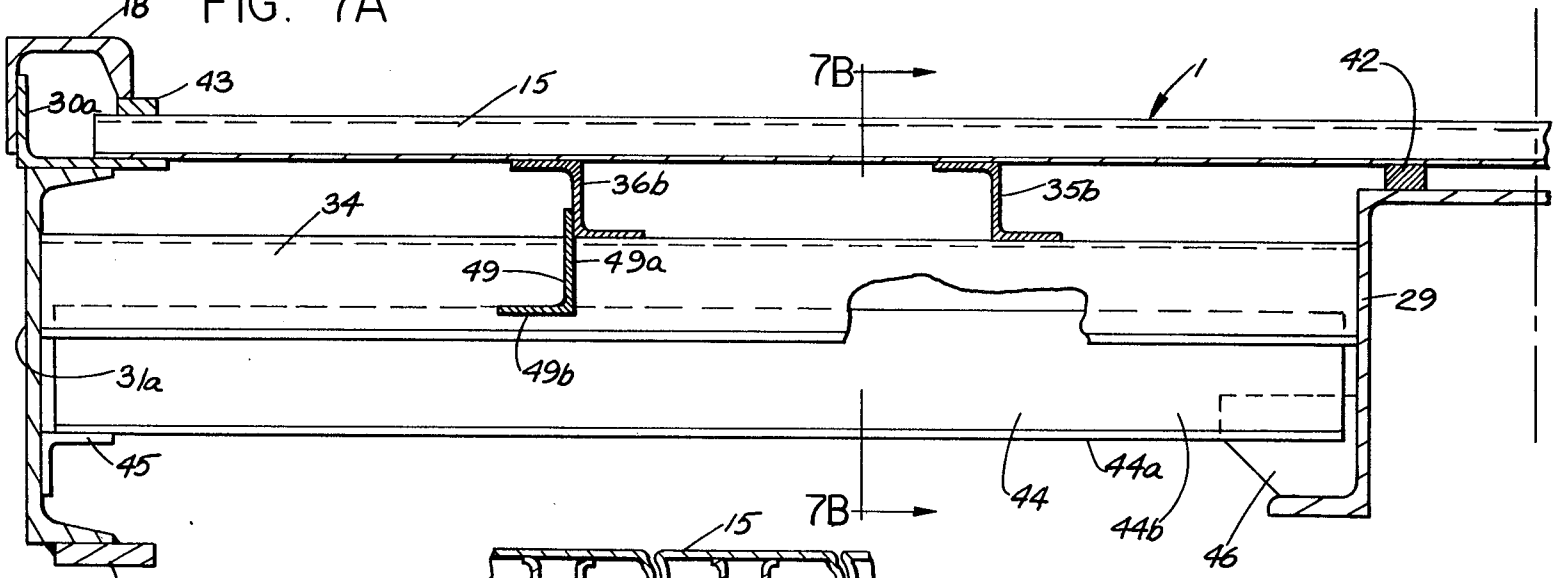
FIG. 7A is a fragmentary cross-sectional view taken along section line 7A—7A of FIG. 5A.

Additional lesser transverse frame members, or cross ties 34, span between the center sill 29 and the adjacent one of the side sill reinforcers 31 and 31*a*. In FIGS. 2 and 5A, the flatcar 1 is shown as having six sets of cross ties 34. A typical cross tie 34 is shown in FIG. 7A. While the cross ties 34 add structural strength to the overall framework, a primary purpose of these members is to serve as additional supports for the floor stringers, next to be described.

The floor stringers, upon which the flooring is supported, comprise structural members extending longitudinally of the car 1. In FIGS. 2 and 5A, two inboard floor stringers are shown at 35*a* and 35*b* and two outboard floor stringers are shown at 36*a* and 36*b*. Each floor stringer 35*a*, 35*b* and 36*a*, 36*b* comprises a main portion extending from bolster 32 to bolster 32 and end portions extending from each bolster 32 to the adjacent end sill 37 or 37*a*. The floor stringers may have any appropriate cross-sectional configuration. A commonly encountered cross-sectional configuration is that of a Z-shape, as shown in FIG. 6A. As is clearly shown in FIGS. 6A and 7A, the lower horizontal legs of floor stringers 35*b* and 36*b* are supported by and affixed to (by welding or the like) the upper edges of the cross bearers 33 and cross ties 34. The same is true of floor stringers 35*a* and 36*a*. The upper horizontal legs of floor stringers 35*b* and 36*b* support and are affixed to the floor 15 by welding or the like, or to floor 24, in the case of the circus loaded flatcar embodiment 1*a* of FIG. 3. Again, the same is true of floor or stringers 35*a* and 36*a*. In the crane loaded embodiment 1 of the flatcar of the present invention, those portions of the floor stringers 35*a*, 35*b* and 36*a*, 36*b* can be eliminated at the hitch end of the car where the nailable floor has been eliminated. In the circus loaded embodiment 1*a* of the flatcar of the present invention, the floor stringers will remain in tact throughout the length of the car.

The underframe of flatcar 1 or 1*a* may contain other structural members. These other structural members have been eliminated in FIGS. 2 and 5A, since they are not directly involved in the practice of the present invention.

As indicated above, the underframe of the flatcars of the present invention will require some reinforcing so that they will comply with A.A.R. requirements and to make up for structural strength lost through the removal of the sides, ends and roof of the box car from which they are made. The flatcars of tne present invention are reinforced to meet T.O.F.C. (Trailer On Flatcar) requirements.

Turning first to the side sill assemblies 30–31 and 30*a*–31*a*, it will be understood that the original nature of these side sill assemblies will depend upon the nature of the box car chosen for conversion according to the present invention. Those box cars having small, single, 8-foot doors on either side and opposed to each other may have side sill assemblies of such-modest strength and construction that they would require replacement. Under these circumstances, economics would dictate whether such a car was a good candidate for conversion according to the present invention. Normally, box cars having double doors or doors on either side staggered with respect to each other are provided with heavier side sill assemblies. Those box cars wherein substantially the entire sides are doors would have quite heavy side sill assemblies requiring little or no reinforcement. It has been found that to be an excellent candidate for the conversion taught herein, the box car should have side sill assemblies having vertical dimensions of at least about 12 inches and preferably of at least about 15 inches.

Reference is now made to FIGS. 4A, 4B, 5A and 6A. The exemplary conversion flatcar 1 illustrated in these Figures is shown as having angle iron-type side sills 30 and 30*a* and side sill reinforcers 31 and 31*a* of channel-shaped cross section. In many types of box-cars, the side sill reinforcers terminate near bolsters 32. Side sill reinforcer 31*a* is provided with extensions 31*b* and 31*c* extending between and affixed (as by welding or the like) to the ends of side sill renforcer 31*a* and the adjacent end sills 37 and 37*a*. Extensions 31*b* and 31*c* may be additionally plug welded as at 31*d*, if desired. Side sill reinforcer 31 will be provided with similar extensions (not shown).

As the side sill reinforcer 31*a* approaches the bolsters 32 at both the A and B ends of the car, its depth is reduced as at 31*e* and 31*f* to end portions 31*f* and 31*g* of lesser vertical dimension (see also FIGS. 11A and 12A). At the reduced portions 31*e* and 31*f*, angle iron members 38 and 38*a* are welded (or otherwise appropriately affixed) to side sill reinforcer 31*a* for purposes of reinforcement. Similarly, a bar 39 is welded (or otherwise appropriately affixed) to the lower flange of the side sill reinforcer 31*a* and the lower flange of angle iron members 38 and 38*a*, terminating at about the center line of bolsters 32. It will be understood that the side sill reinforcer 31 will be similarly reinforced.

Figure 5B:
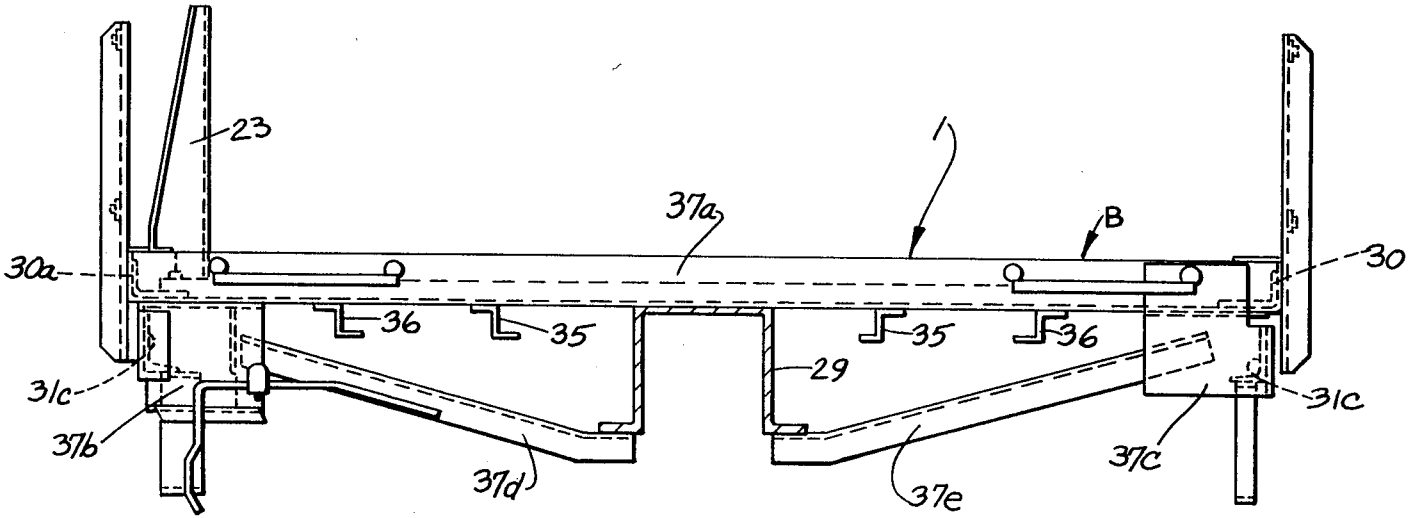
FIG. 5B is a simplified end elevational view of the hitch end of the flatcar of FIG. 2 or the flatcar of FIG. 3.

Under some circumstances, it is desirable to reinforce one or both of the end sills 37 and 37*a*. This is accomplished by providing corner plates 37*b* and 37*c* (if not already present) welded or otherwise appropriately affixed to the end sill 37*a* and extensions 31*b* of side sill reinforcers 31 and 31*a* (see FIG. 5B). Angle iron reinforcing members 37*d* and 37*e* are welded or otherwise affixed at their ends to corner plates 37*b* and 37*c* and center sill 29. FIG. 5B illustrates the B end of flatcar 1. The end sill 37 at the A end of the car can be similarly reinforced if desired or required. Reinforcement of one or both end sills of flatcar 1*a* can be accomplished in the same manner.

As is shown in FIGS. 5A and 6, in the embodiment illustrated, the upper flange of side sill reinforcer 31*a* is surmounted by the angle iron-type side sill 30*a* having a horizontal leg 30*b* welded to the upper side sill reinforcer flange and a vertical leg 30*c*. In the conversion process, a portion 30*d* of the vertical side sill leg 30*c* may be cut and removed when the siDes of the box car are removed. As will be evident from FIG. 5A, the side sill 30 is of similar angle iron configuration.

In FIG. 6A, it will be noted that the conventional nailable steel floor 15 rests upon and is affixed to a pair of parallel-spaced bars 42 and 42*a* (see also FIG. 11B) welded to center sill 29. The nailable steel floor is supported by the floor stringers 35*b* and 36*b*, and the horizontal leg 30*b* of side sill 30*a*.

A steel bar 43 is welded to the nailable steel floor 15 adjacent its edge. The steel bar 43 extends the length of the floor 15. The bulb angle 18 (see also FIG. 2) is welded at one of its longitudinal edges to steel bar 43 and at the other of its longitudinal edges to the upstanding leg 30*c* of side sill 30*a*. The bulb angle 18 may be additionally plug welded to the upstanding side sill leg 30*c*, where desired or required. It will be noted from FIG. 2 that a bulb angle 17 is similarly affixed to the side sill 30. At positions where there is no floor the bulb angles 17 and 18 are connected to the horizontal leg of their respective side sills 30 and 30*a* by a bar. One such bar 17*a* is shown in association with bulb angle 17 in FIG. 11*a*. The bulb angles 17 and 18 finish the longitudinal side edges of the car 1 and additionally strengrhen side sills 30 and 30*a*.

FIG. 6A also illustrates the inside curb or tire guide 20 (see also FIG. 2) which is welded or otherwise appropriately affixed to the nailable steel floor 15. The tire guide 19 (shown in FIG. 2) is similarly welded to floor 15 and the tire guides 19 and 20 are spaced from each other so as to be just nicely straddled by the wheel sets of the highway trailer, as is indicated in FIG. 6A.

In the circus loaded embodiment 1*a* of the flatcar of the present invention, as is shown in FIG. 3, the tire guides 19 and 20 are eliminated. The bulb angle 18 shown in FIG. 6A is replaced by the curb member 28. The curb member 28, as is shown in FIG. 3, extends substantially the length of the car 1*a*. As is shown in FIG. 6B, the curb member comprises a vertical portion 28*a*, a horizontal portion 28*b*, a downwardly and inwardly sloping portion 28*c*, a vertical portion 28*d*, and a flange portion 28*e*. The flange portion 28*e* is welded or otherwise appropriately affixed to the nailable steel floor 24 near the edge thereof. The vertical curb portion 28*a* is welded to the upstanding leg 30*c* of side sill 30*a* and may be additionally plug welded, where needed.

It will be understood that the curb member 27, shown in FIG. 3, is identical to curb member 28 and is identically affixed above side sill 30. The curb members 27 and 28 not only reinforce side sills 30 and 30*a*, respectively, but also serve as guide means for the highway trailer when driven on and driven off the circus loaded car 1*a*.

FIG. 6A illustrates a typical cross bearer half 33*a*. It will be understood that the cross bearers of the circus loaded embodiment 1*a* of the present invention will be substantially identical. Normally, the cross bearers will not require reinforcement. Should reinforcement be required or desired, however, bar means (not shown), similar to the bar 39 affixed to the lower flange of side sill reinforcer 31*a*, may be affixed to the bottom edge of the cross bearer 33.

FIG. 7A illustrates a typical cross tie 34 of crane loaded flatcar 1. It will be understood that the cross ties of circus loaded flatcar 1*a* are identical and will be identically reinforced. Cross tie 34 is welded at one of its ends to center sill 29 and at the other of its ends to side sill reinforcer 31*a*. The primary purpose of cross tie 34 is to serve as a support for floor stringers 35*b* and 36*b*. All of the cross ties of the bogie end of the flatcar 1 should be reinforced. The same is true of circus loaded car 1*a*. The cross ties at the B end of both types of cars generally need not be reinforced (see FIG. 9).

Figure 7B:
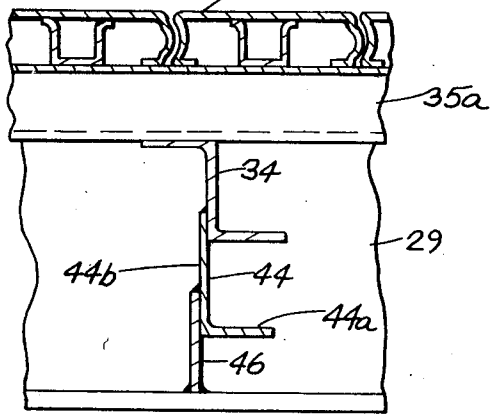
FIG. 7B is a fragmentary cross-sectional view taken along section line 7B—7B of FIG. 7A.

Cross tie 34 may have any appropriate cross-sectional configuration. A common cross-sectional configuration is a Z-shape, as is shown in FIG. 7B. To reinforce the cross tie 34, by essentially increasing its vertical dimension, an angle iron 44 is provided. The angle iron 44 has a horizontal leg 44*a* and a vertical leg 44*b*. The vertical leg 44*b* is welded (or otherwise appropriately affixed) to the lower part of the vertical web portion of the Z-shaped cross tie 34. The out-board end of reinforcing angle iron 44 may be supported by and affixed to a short angle iron member 45 welded or otherwise fastened to the inside surface of side sill reinforcer 31*a*. The in-board end of reinforcing angle iron 44 is supported by and affixed or welded to a gusset 46, in turn affixed or welded to center sill 29. All of the cross ties 34 to be reinforced, on either side of center sill 29, On either embodiment of flatcar 1 and 1*a*, may be reinforced in the same manner described with respect to FIGS. 7A and 7B.

Figures 8A, 8B:
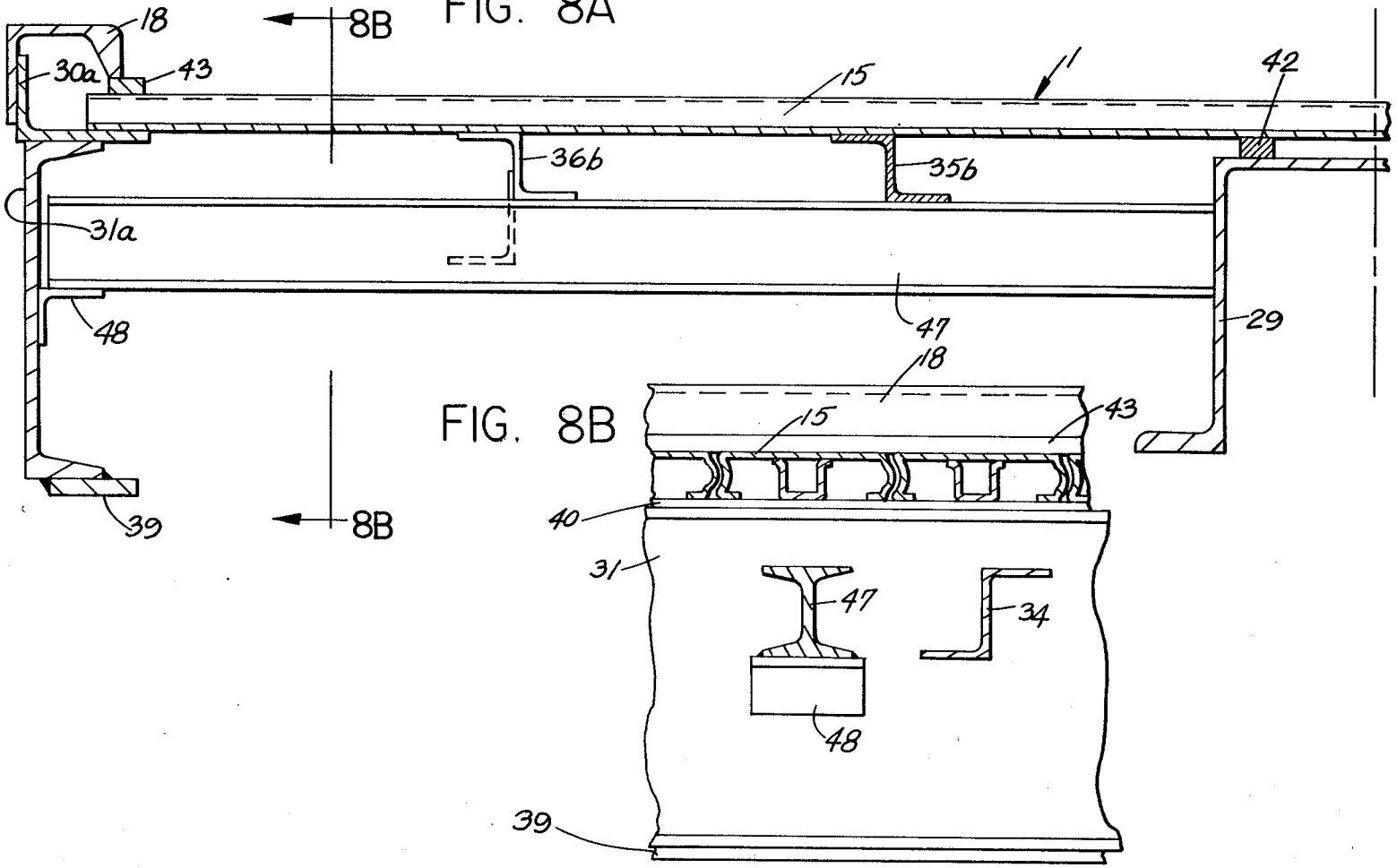
FIG. 8A is a fragmentary cross-sectional view taken along section line 8A—8A of FIG. 5A.
FIG. 8B is a fragmentary cross-sectional view taken along section line 8B—8B of FIG. 8A.

In some instances, a cross tie 34 cannot be reinforced in the manner described with respect to FIGS. 7A and 7B, because of the presence of some piece of conventional underframe equipment (such as brake equipment or the like), affixed to the frame and precluding access to the cross tie or not permitting sufficient room for such reinforcement. In such an instance, the problem can be solved by simply adding an additional cross tie as near as possible to the unreinforceable cross tie. This is illustrated in FIGS. 8A and 8B. In FIG. 8B, the existing cross tie is shown at 34. Assuming, for purposes of this description, that reinforcement of cross tie 34 is not feasible, an additional cross tie 47 is located as near thereto as possible. The added cross tie 47 is also shown in FIG. 5A. The cross tie 47 may have any appropriate cross-sectional configuration, including a Z-shape similar to cross tie 34. For purposes of an exemplary showing, the cross tie 47 is illustrated as being an I-beam. The in-board end of added cross tie 47 is welded or otherwise affixed to the adjacent side of center sill 29. The out-board end of added cross tie 47 is welded or fastened to a small angle iron member 48 which is, itself, welded or fastened to the inside surface of side sill reinforcer 31*a*. Added cross tie 47, as is true of the other cross ties 34, serves as part of the framework structure of the flatcar 1, and primarily as support means for floor stringers 35*b* and 36*b*. If necessary, an added cross tie may be mounted in the frame structure of the circus loaded car 1*a*, in precisely the same manner.

Figure 9:
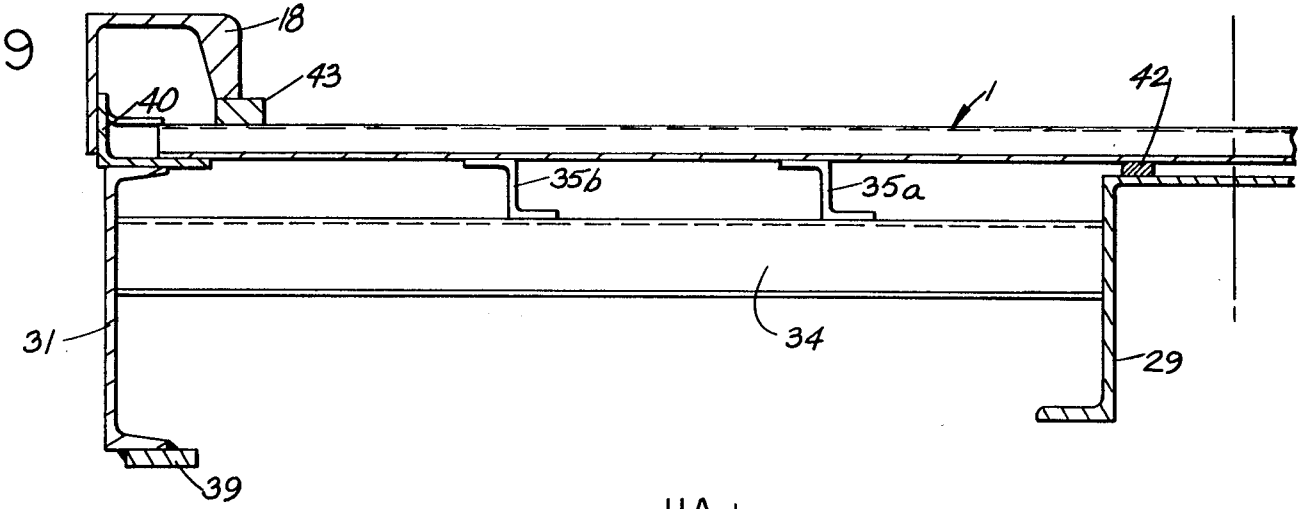
FIG. 9 is a fragmentary cross-sectional view taken along section line 9—9 of FIG. 5A.

FIG. 9 illustrates that cross tie of the hitch end of flatcar 1, nearest the longitudinal center of the car (see also FIG. 5A). In the circus loaded car 1*a* of FIG. 3, the floor stringers 35 and 36 extend substantially the full length of the car. In the crane loaded embodiment 1, the floor stringers 35*b* and 36*b* terminate at the cross tie illustrated in FIG. 9. Normally, it will not be necessary to reinforce this cross tie. If desired, however, it can be reinforced in the manner described with respect to FIGS. 7A and 7B or the manner described with respect to FIGS. 8A and 8B.

Reference is now made to FIGS. 5A and 7A. In the crane loaded embodiment 1 and in the circus loaded embodiment 1*a* of the flatcar of the present invention, it has been found advantageous to reinforce the out-board floor stringers 36*a* and 36*b* at the bogie end of the car. This is accomplished by welding or otherwise affixing angle iron segments to those portions of the out-board floor stringers 36*a* and 36*b* which span the space between the end sill 37 (see FIG. 5A) and the bolster 32, the space between bolster 32 and the adjacent cross tie 34, the spaces between adjacent cross ties 34 and the spaces between the cross bearers and adjacent cross ties. Such reinforcing angle iron segments are shown in FIG. 5A at 49. A typical angle iron reinforcement segment is illustrated in FIG. 7A. The reinforcement angle iron segment 49 has an upstanding leg 49*a* and a horizontal leg 49*b*. The upper end of the upstanding leg 49*a* is welded or appropriately attached to the central web of out-board stringer 36*b*. Preferably, the angle iron reinforcing segment 49 is so oriented that its horizontal leg 49*b* extends in an out-board direction toward the adjacent side sill reinforcer 31*a*. In some instances, under-car equipment will not permit this orientation of the reinforcing angle iron segment 49, with the result that it may be welded or attached to the out-board floor stringer 36*b* with its horizontal leg 49*b* extending in an in-board direction toward center sill 29. An instance of this is illustrated at 49*c* in FIG. 5A.

It has been determined that reinforcement of the cross ties 34 and the out-board floor stringers 36*a* and 36*b* need only be made at the bogie end of the car, up to about the longitudinal center of the car (see FIG. 5A). This is true both for the crane loaded embodiment 1 of FIG. 2 and the circus loaded embodiment 1*a* of FIG. 3. The side sill assemblies 30–31 and 30*a*–31*a*, on the other hand, should be appropriately reinforced substantially throughout their length. Reinforcement of the bogie end of the car is required by virtue of the fact that this is the highway trailer bogie supporting end of the car which will be subjected to considerable vertical dynamics during running of the car. The cross ties and out-board floor stringers at the hitch end of the car will normally be of sufficient strength to take the vertical dynamics of highway trailer loading, without additional reinforcement.

Figure 10A:
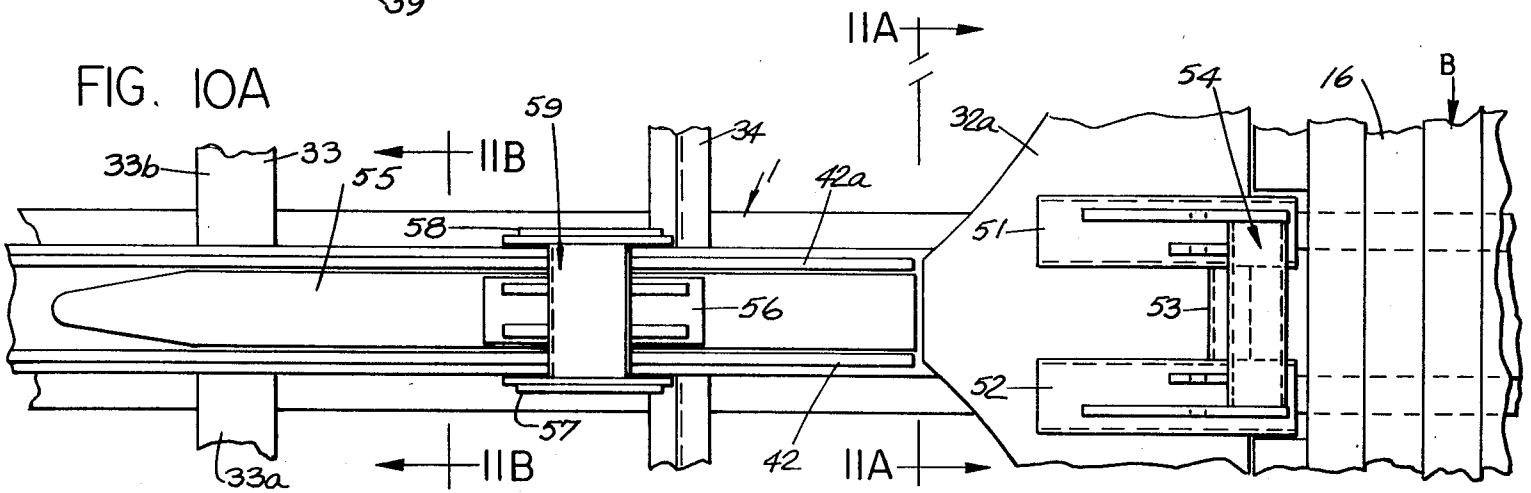
FIG. 10A is a fragmentary plan view of the mounting assembly for the trailer hitch of the flatcar of FIG. 2.

Reference is now made to FIGS. 10A, 11A and 11B, wherein the mount for the trailer hitch 14 of the crane loaded embodiment 1 of the flatcar of the present invention is illustrated. In FIG. 11A, the hitch end bolster 32 is shown with its top cover plate 32*c*. This top cover plate 32*a* is illustrated in FIG. 10A as well. Immediately behind bolster 32, a reinforcing plate 50 is welded to the flanges of center sill 29 (see FIG. 11B). The plate 50 spans the flanges of the center sill and extends from a position immediately inboard of the bolster 32 to the adjacent cross bearer to which it is attached.

A conventional, commercially available rigid hitch can be mounted on flat car 1. To accomplish this (as is most clearly shown in FIGS. 10A and 11A), a pair of U-shaped channel members 51 and 52 are welded to the bolster top plate 32*a* in parallel-spaced relationship and extending longitudinally of the car 1. An additional smaller channel member 53 is welded between members 51 and 52 and to the bolster top cover plate 32*a*. The front mount, generally indicated at 54, for the conventional trailer hitch 14 is usually supplied with the trailer hitch and can be mounted on channel members 51, 52 and 53. It will be noted that the channel members 51 and 52 have their upper surfaces lying at a level substantially coplanar with the upper surface of the nailable floor 16 and thereby assure proper height of the trailer hitch 14 (see FIG. 1).

Reference is now made to FIGS. 10A and 11B. It will be noted that from a point immediately in-board of the bolster top cover plate 32*a*, the upper surface of center sill 29 has a central reinforcing plate 55 welded (or otherwise appropriately affixed) thereto. The plate 55 extends longitudinally of the center sill as shown. The spacer bar 42, previously described in its capacity as a support for the nailable steel flooring, is located on the upper surface of center sill 29 to one side of reinforcing plate 55. The counterpart of spacer bar 42 is shown at 42*a* in FIGS. 10A and 11B, extending along the other side of reinforcing plate 55.

A channel member 56 is welded or otherwise affixed to reinforcing plate 55. Channel member 56 is similar to channels 51 and 52 previously described. A pair of plate assemblies 57 and 58 are welded or attached in appropriate manner to the sides of center sill 29 adjacent channel member 56.

The rear mount for the trailer hitch (usually supplied with the hitch) is generally indicated at 59 and is welded or otherwise affixed to plate assemblies 57 and 58 and to channel member 56.

As indicated above, the nature of the trailer hitch 14 on the crane loaded embodiment 1 of the flatcar of the present invention does not constitute a limitation of the present invention. While a collapsible trailer hitch can be used, a rigid trailer hitch is adequate. The trailer hitch is conventional and is readily available from various suppliers of railway equipment. An exemplary trailer hitch of the non-retractable, cushioned type, suitable for this purpose, is manufactured by Pullman Standard, Inc., of Chicago, Illinois, under the designation NRC-1-47. If a trailer hitch designed and sized for conversion car 1 was used, the various elements 51, 52 53, 56, 57 and 58 could be eliminated.

Figure 10B:
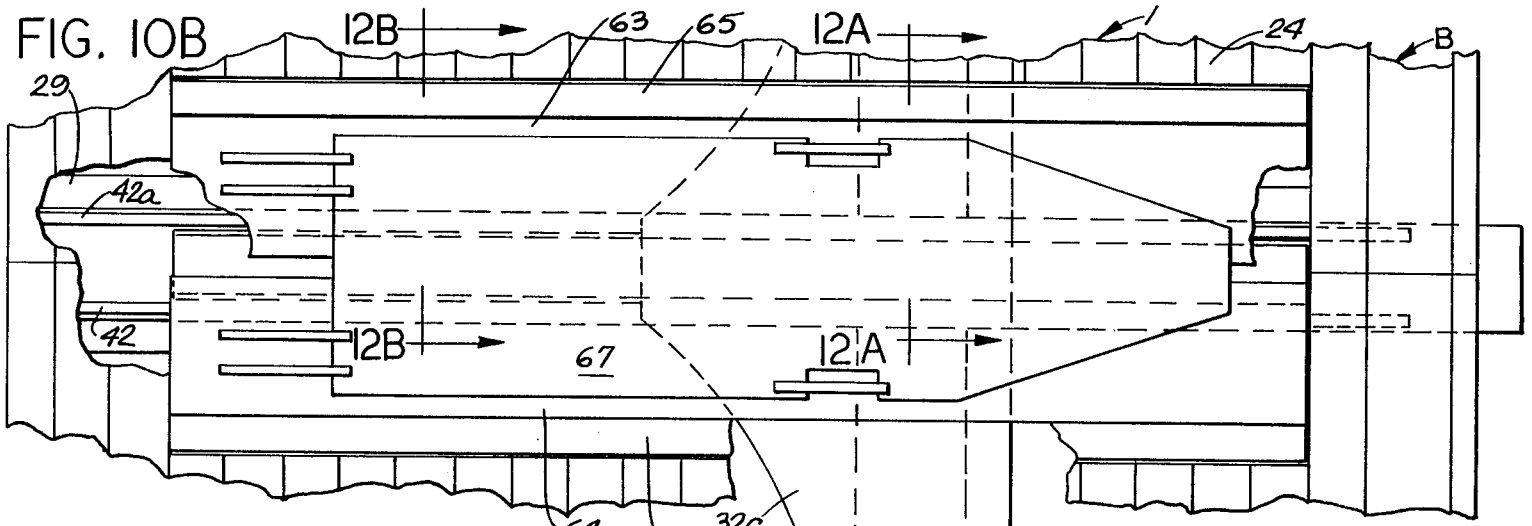
FIG. 10B is a fragmentary plan view of the mounting assembly for the trailer hitch of the flatcar of FIG. 3.

Reference is now made to FIGS. 3, 10B, 12A and 12B, illustrating modifications for application of a retractable hitch for car 1*a*. In FIGS. 10B and 12A, the center sill 29 is shown, together with bolster 32 and bolster top cover plate 32*c*. Spacer bars 42 and 42*a* are also shown, and it will be evident from FIG. 12B that a plate 60, equivalent to plate 50 of FIG. 11B, is welded or otherwise affixed to and spans the flanges of center sill 29, extending longitudinally of the circus loaded car 1*a*, and being connected to the adjacent cross bearer. A reinforcing plate 61 is mounted on the upper surface of center sill 29 and is equivalent to reinforcing plate 55 of FIG. 11B. Mounted on the reinforcing plate 61 and the top cover plate 32*c* of bolster 32, there is a longitudinally extending U-shaped or C-shaped channel 62.

A pair of identical floor plates 63 and 64 have their in-board longitudinal edges welded in parallel-spaced relationship to the channel member 62. The floor plates 63 and 64 extend longitudinally of the car. At their out-board edges, the floor plates 63 and 64 have downturned portions which rest upon and are welded to the top cover plate 32*c* of bolster 32.

To fill in the space between the flooring 24 and the floor plates 63 and 64, a pair of filler angles 65 and 66 are provided. The filler angles 65 and 66 have their horizontal legs welded or otherwise affixed to the adjacent one of the floor plates 63 and 64. The vertical legs of the filler angles 65 and 66 are skip welded to the adjacent nailable steel floor.

As is shown in all of FIGS. 10B, 12A and 12B, the base plate 67 of a conventional collapsible trailer hitch is welded or otherwise affixed to the floor plates 63 and 64. Any conventional collapsible trailer hitch can be used, such as that manufacturered by ACF Industries, Inc., Amcar Division, of Earth City, Mo., under the designation Model No. 5, a 47-inch cushioned trailer hitch.

It will be understood that other changes in the flatcars may be required, such as modifications to the brake system, draft gear and the like, to meet the A.A.R. requirements for such modified cars. Such changes, however, are well known to those skilled in the art and do not constitute a limitation on the present invention. Similarly, additional elements should be added to the car, such as brackets at diagonal corners for portable bridge plates (in the circus loaded embodiment), roping staples and the like. Again, such items do not constitute a part of the present invention.

The flatcars of the present invention may be heated at selected areas to impart a camber to the car, as is well known in the art. A camber of about 1.5 inches, $\pm 0.25$ inch from end to end has been found suitable, for example.

Modifications may be made in the invention without departing from the spirit of it. For example, as indicated above, while a nailable steel floor is preferred, other types of flooring can be used with the flatcars of the present invention. If the original box car from which the flatcar is made has a wooden floor, this wooden floor can be retained, replaced with another wooden floor, or replaced with a nailable steel floor. Flooring made up of alternate wood and steel members is also known in the art. Where a non-steel floor is used, the manner of mounting the in-board edges of bulb angles 17 and 18 or curbs 27 and 28 will require modification, well within the skill of the worker in the art. The same is true of the tire guides 19 and 20 of the crane loaded embodiment of FIG. 2.

When an A.A.R. Plate "F" clearance is required, at least that portion of the nailable steel floor (at the bogie end of either embodiment of the flatcar) which supports the highway trailer bogie tire sets can be replaced with a steel plate. This will lower the trailer by a sufficient amount to meet this clearance.

Finally, while the present invention has been described in terms of the conversion of a conventional box car (and particularly a 50-foot, 50-ton box car) to a T.O.F.C. flatcar, other types of railway cars, such as gondola or flat cars, might well make good candidate cars for conversion according to the present invention. The key considerations are that the car have sufficient length and an appropriate underframe construction such that conversion would be economically feasible.

What is claimed is:

1. A method of converting a conventional box car to a flatcar for carrying a highway trailer of the type having bogie mounted tire sets near one end and a hitch member near the other end, said method comprising the steps of providing a conventional box car of a length of at least 50 feet with an underframe mounted on railway trucks, a floor, sides, ends and a roof, said underframe comprising a longitudinally extending center sill, a pair of longitudinally extending side sill assemblies located to each side of said center sill and in parallel-spaced relationship therewith, means to pivotally mount said railway trucks to said center sill, a transversely extending bolster located at each railway truck mounting means, each bolster connecting said center sill and said side sill assemblies, a plurality of transversely extending cross bearers, each cross bearer connecting said center sill and said side sill assemblies, said cross bearers being located between said bolsters in parallel-spaced relationship thereto and to each other, aligned pairs of transversely extending cross ties, the cross ties of each aligned pair thereof extending from each side of said center sill to the adjacent one of said side sill assemblies, said aligned pairs of cross ties being located between said cross bearers and between said bolsters and the adjacent ones of said cross bearers in parallel-spaced relationship thereto and to each other, a plurality of floor stringers extending the length of said car in parallel-spaced relationship, said floor stringers being supported by and affixed to said bolsters, cross bearers and cross ties, said floor being supported by and affixed to said floor stringers, said method comprising the further steps of removing said sides, ends and roof substantially at the level of said floor, designating a highway trailer bogie supporting end and a hitch supporting end of said flatcar, reinforcing said side sill assemblies substantially throughout their length, reinforcing said cross ties at said bogie supporting end of said car, reinforcing spanning portions of the two out-board floor stringers nearest said side sill assemblies at said bogie supporting end of said flatcar, providing mounting means at said hitch supporting end of said flatcar adjacent said bolster for a conventional trailer hitch, and affixing a trailer hitch to said mounting means.

2. The method claimed in claim 1 including the step of affixing a bar to the bottom edge of each side sill assembly extending at least from bolster to bolster.

3. The method claimed in claim 1 including the step of affixing a beam-like member to each end of each side sill assembly and to the adjacent one of said end sills.

4. The method claimed in claim 1 including the steps of providing an angle iron member for each cross tie to be reinforced, said angle iron member having a vertical leg and a horizontal leg and being of a length slightly less than the cross tie to be reinforced, affixing the upper portion of said vertical leg longitudinally along said cross tie to be reinforced so that said angle iron member depends downwardly therefrom effectively increasing the vertical dimension of said cross tie, and operatively connecting the ends of said angle iron member to said center sill and the adjacent one of said side sill assemblies.

5. The method claimed in claim 1 including the step of adding at least one additional cross tie adjacent to and parallel to a cross tie to be reinforced, and affixing the ends of said additional cross tie to said center sill and the adjacent one of said side sill assemblies.

6. The method claimed in claim 1 including the steps of providing a reinforcing angle iron segment having a vertical leg and a horizontal leg for each of said spanning portions of said out-board floor stringers at said bogie supporting end of said flatcar, affixing the upper portion of said vertical leg longitudinally along its respective floor stringer spanning portion so as to depend therefrom and increase the vertical dimension thereof.

7. The method claimed in claim 1 including the steps of affixing corner plates to the ends of at least one of said end sills, providing a pair of angle iron braces, affixing one end of each angle iron brace to one of said corner plates and the other end of said angle iron brace to said center sill.

8. The method claimed in claim 1 wherein said bolster at said hitch supporting end of said flatcar is provided with a conventional top cover and said center sill is of inverted U-shaped cross-sectional configuration having an upper horizontal portion and downwardly depending legs terminating in laterally extending flange portions, and including the steps of affixing a first reinforcing plate to said center sill flange portions spanning said flange portions and extending longitudinally of said center sill from said bolster to the adjacent one of said cross bearers, affixing a second reinforcing plate to said horizontal portion of said center sill extending from said bolster to the adjacent one of said cross bearers, and operatively connecting said conventional trailer hitch to at least one of said bolster top cover, said second reinforcing plate and said center sill.

9. The method claimed in claim 1 wherein said flatcar comprises a crane loaded flatcar and each of said side sill assemblies comprising a side sill reinforcer surmounted by a longitudinal angle iron-type side sill extending substantially the length of said flatcar and having a vertical leg and a horizontal leg extending inwardly of said flat car and supporting the adjacent longitudinal edge of said floor, and including the steps of providing a bulb angle extending along each side of said flatcar substantially the length thereof and surmounting the adjacent one of said longitudinal side sills affixing each bulb angle to said vertical leg of the adjacent one of said longitudinal side sills and operatively connecting each of said bulb angles to said floor where present and to said horizontal leg of said adjacent longitudinal side sill in the absence of said floor, providing a pair of tire guides, mounting said tire guides in parallel-spaced relationship on said floor at said bogie supporting end of said flatcar extending longitudinally of said flatcar and spaced to be straddled by said highway trailer tire sets.

10. The method claimed in claim 9 including the step of affixing a bar to the bottom edge of each side sill assembly extending at least from bolster to bolster.

11. The method claimed in claim 9 including the step of affixing a beam-like member to each end of each side sill assembly and to the adjacent one of said end sills.

12. The method claimed in claim 9 including the steps of providing an angle iron member for each cross tie to be reinforced, said angle iron member having a vertical leg and a horizontal leg and being of a length slightly less than the cross tie to be reinforced, affixing the upper portion of said vertical leg longitudinally along said cross tie to be reinforced so that said angle iron member depends downwardly therefrom effectively increasing the vertical dimension of said cross tie, and operatively connecting the ends of said angle iron member to said center sill and the adjacent one of said side sill assemblies.

13. The method claimed in claim 9 including the step of adding at least one additional cross tie adjacent to and parallel to a cross tie to be reinforced, and affixing the ends of said additional cross tie to said center sill and the adjacent one of said side sill assemblies.

14. The method claimed in claim 9 including the steps of providing a reinforcing angle iron segment having a vertical leg and a horizontal leg for each of said spanning portions of said out-board floor stringers at said bogie supporting end of said flatcar, affixing the upper portion of said vertical leg longitudinally along its respective floor stringer spanning portion so as to depend therefrom and increase the vertical dimension, thereof.

15. The method claimed in claim 9 including the steps of affixing corner plates to the ends of at least one of said end sills, providing a pair of angle iron braces, affixing one end of each angle iron brace to one of said corner plates and the other end of said angle iron brace to said center sill.

16. The method claimed in claim 1 wherein said flatcar comprises a circus loaded flatcar and each of said side sill assemblies comprises a side sill reinforcer surmounted by a longitudinal angle iron-type side sill extending substantially the length of said flat car and having a vertical leg and a horizontal leg extending inwardly of said flat car and supporting the adjacent longitudinal edge of said floor, and including the steps of providing an elongated curb memher of substantially inverted U-shaped cross-section extending along each side of said flatcar substantially the length thereof and surmounting the adjacent one of said longitudinal side sills, affixing each curb member to said vertical leg of said adjacent one of said longitudinal side sills and to said floor, removing a portion of said floor at said hitch supporting end of said flatcar adjacent said bolster, affixing said trailer hitch mounting means to said bolster and said center sill at the position of said removed floor and affixing a conventional collapsible trailer hitch to said hitch mounting means.

17. The method claimed in claim 16 including the step of affixing a bar to the bottom edge of each side sill assembly extending at least from bolster to bolster.

18. The method claimed in claim 16 including the step of affixing a beam-like member to each end of each side sill assembly and to the adjacent one of said end sills.

19. The method claimed in claim 16 including the steps of providing an angle iron member for each cross tie to be reinforced, said angle iron member having a vertical leg and a horizontal leg and being of a length slightly less than the cross tie to be reinforced, affixing the upper portion of said vertical leg longitudinally along said cross tie to be reinforced so that said angle iron member depends downwardly therefrom effectively increasing the vertical dimension of said cross tie, and operatively connecting the ends of said angle iron member to said center sill and the adjacent one of said side sill assemblies.

20. The method claimed in claim 16 including the step of adding at least one additional cross tie adjacent to and parallel to a cross tie to be reinforced, and affixing the ends of said additional cross tie to said center sill and the adjacent one of said side sill assemblies.

21. The method claimed in claim 16 includng the steps of providing a reinforcing angle iron segment having a vertical leg and a horizontal leg for each of said spanning portions of said out-board floor stringers at said bogie supporting end of said flatcar, affixing the upper portion of said vertical leg longitudinally along its respective floor stringer spanning portion so as to depend therefrom and increase the vertical dimension thereof.

22. The method claimed in claim 16 including the steps of affixing corner plates to the ends of at least one of said end sills, providing a pair of angle iron braces, affixing one end of each angle iron brace to one of said corner plates and the other end of said angle iron brace to said center sill.

23. A method of converting a conventional railway box car of at least 50-foot length to a railway T.O.F.C. flatcar according to A.A.R. standards for carrying a highway trailer having bogie mounted tire sets at one end and a hitch member at the other end, said conventional box car being of the type having an underframe mounted on railway trucks, a floor, sides, ends and a roof, said method comprising the steps of removing said sides, ends and roof of said box car substantially at floor level, designating a bogie supporting end and a hitch supporting end of said railway car, reinforcing said underframe to said A.A.R. standards for a railway T.O.F.C. flatcar and affixing a conventional trailer hitch to said hitch supporting end of said flatcar.

* * * * *